US011295663B2

(12) United States Patent
Wang

(10) Patent No.: US 11,295,663 B2
(45) Date of Patent: Apr. 5, 2022

(54) METHOD OF ADJUSTING BRIGHTNESS OF DISPLAY PANEL AND STORAGE MEDIUM

(71) Applicant: SHENZHEN CHINA STAR OPTOELECTRONICS SEMICONDUCTOR DISPLAY TECHNOLOGY CO., LTD., Guangdong (CN)

(72) Inventor: Limin Wang, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 247 days.

(21) Appl. No.: 16/620,895

(22) PCT Filed: Nov. 15, 2019

(86) PCT No.: PCT/CN2019/118629
§ 371 (c)(1),
(2) Date: Dec. 10, 2019

(87) PCT Pub. No.: WO2021/088108
PCT Pub. Date: May 14, 2021

(65) Prior Publication Data

US 2021/0335227 A1 Oct. 28, 2021

(30) Foreign Application Priority Data

Nov. 6, 2019 (CN) ..... 201911077871.2

(51) Int. Cl.
*G09G 3/3225* (2016.01)
*G09G 5/10* (2006.01)

(52) U.S. Cl.
CPC ..... *G09G 3/3225* (2013.01); *G09G 5/10* (2013.01); *G09G 2320/0626* (2013.01)

(58) Field of Classification Search
None
See application file for complete search history.

(56) References Cited

U.S. PATENT DOCUMENTS

2006/0273997 A1* 12/2006 Nathan ..... G09G 3/3241 345/78
2007/0285378 A1* 12/2007 Lankhorst ..... H05B 45/22 345/102
2009/0224678 A1* 9/2009 Wang ..... G09G 3/3426 315/158
2016/0307498 A1* 10/2016 Chaji ..... G09G 3/3291
2021/0005128 A1* 1/2021 Li ..... G09G 3/3225

* cited by examiner

*Primary Examiner* — Kent W Chang
*Assistant Examiner* — Benjamin Morales

(57) ABSTRACT

A method of adjusting brightness of a display panel includes a database creation step: storing attenuation data and a plurality of first brightness gain factors in a database. The attenuation data is performance attenuation data of a functional device of a display panel, and the first brightness gain factors are provided to display brightness of the display panel. A retrieving step: retrieving the attenuation data and the first brightness gain factors from the database. An adjustment step: adjusting the first brightness gain factors according to the attenuation data to obtain a plurality of second brightness gain factors.

9 Claims, 2 Drawing Sheets

METHOD OF ADJUSTING BRIGHTNESS OF DISPLAY PANEL AND STORAGE MEDIUM

BACKGROUND OF INVENTION

1. Field of Invention

The present invention relates to a technical field of displays, and particularly to, a method of adjusting brightness of a display panel and a storage medium.

2. Related Art

Active-matrix organic light-emitting diode (AMOLED) displays are new display technologies, and their ever-changing development and advancement have led to an increasingly rich display product.

Uniformity compensation for displays is required due to uneven display characteristics caused by technique and process reasons. In displaying, driver units and light-emitting units of thin-film transistor (TFT) devices or the AMOLED devices may have characteristic drift, resulting in a display unevenness problem getting worse. For this reason, it needs to detect and compensate for the characteristic drift of devices.

In response to the characteristic drift of devices in AMOLED displays, various compensation solutions have been offered by industries. In addition to precise compensation of device characteristics, display uniformity can also be realized by adjusting brightness of the displays. Current brightness adjustment solutions are generally based on fixed brightness adjustment factors. After used for a long time, attenuation of AMOLED pixels in middle of display panels is serious, which may give rise to serious adverse influence on lifetimes. Current compensation methods continue to worsen the problem.

Therefore, it is imperative to provide an improved method of adjusting brightness of a display panel and a storage medium to ensure that not only the brightness of the display panel can be adjusted, but also a problem of deterioration of devices in a middle of the display panel can be solved.

SUMMARY OF INVENTION

An object of present invention is to provide a method of adjusting brightness of a display panel and a storage medium to obtain attenuation information of the display panel by external compensation detection or data estimation, thereby to adjust brightness data of different areas of the display panel.

In order to overcome the above-mentioned problem, the present invention provides a method of adjusting brightness of a display panel, comprising a database creation step: storing attenuation data and a plurality of first brightness gain factors in a database, wherein the attenuation data is performance attenuation data of a functional device of a display panel, and the first brightness gain factors are provided to display brightness of the display panel; a retrieving step: retrieving the attenuation data and the first brightness gain factors from the database; and an adjustment step: adjusting the first brightness gain factors according to the attenuation data to obtain a plurality of second brightness gain factors.

Furthermore, the method further comprises an output step: outputting the second brightness gain factors to the display panel for screen display.

Furthermore, the attenuation data contains attenuation data of a thin-film transistor device or attenuation data of an organic light-emitting diode (OLED) functional device.

Furthermore, prior to the database creation step, the method further comprises a preparation step: providing a display panel configured with a central brightness gain factor and peripheral brightness gain factors.

Furthermore, after the preparation step, the method further comprises a setting step: obtaining a larger difference value between first brightness gain factors of a center of the display panel and first brightness gain factors of peripheral edges of the display panel by increasing the central brightness gain factor, and reducing the peripheral brightness gain factors.

Furthermore, the adjustment step further comprises decreasing the first brightness gain factors of a center of the display panel to obtain the second brightness gain factor of the center of the display panel when attenuation data of the center of the display panel is increased, thereby to obtain a small difference value between the central brightness gain factor and the peripheral brightness gain factors of the display panel.

Furthermore, in the preparation step, both the central brightness gain factor and the peripheral brightness gain factors of initialization are the same as each other.

Furthermore, the first brightness gain factors of peripheral edges of the display panel are calculated through a bilinear difference value, according to the adjusted second brightness gain factors of the center of the display panel, to obtain second brightness gain factors of the peripheral edges of the display panel.

Furthermore, a gradation brightness gain factor is further provided between the central brightness gain factor and the peripheral brightness gain factors, and the gradation brightness gain factor is less than or equal to the central brightness gain factor and is greater than or equal to the peripheral brightness gain factors.

The present invention further provides a computer-readable storage media, storing a computer program, wherein the computer program, when executed by a processor, is capable of implementing the aforementioned method.

The present invention provides a method of adjusting brightness of a display panel and a storage medium. Brightness adjustment gain factor diagrams are obtained according to attenuation data of a center and peripheral edges of the display panel (obtaining attenuation information of the display panel by methods, such as external compensation detection or data estimation), thereby to process brightness gain factors of the display panel. When lifetime degradation of a device of the display panel is not serious, a brightness difference between gain factors of a center and peripheral edges of the display panel is set to a large difference value to reduce power consumption. When lifetime degradation of a device at the center position is serious, the gain factors of the display panel are adjusted to reduce a brightness difference between the center and the peripheral edges of the display panel, thereby improving lifetime degradation of devices at corresponding positions, and reducing adversely influence on a lifetime of a display while brightness adjustment is fulfilled.

BRIEF DESCRIPTION OF DRAWINGS

To better illustrate embodiments or technical solutions in the prior art, a brief description of the drawings used in the embodiments or the prior art description will be given below. Obviously, the accompanying drawings in the following description merely show some embodiments of the present invention, and a person skilled in the art may still derive other drawings from these accompanying drawings without creative efforts.

DESCRIPTION OF PREFERRED EMBODIMENTS

Figure 1:
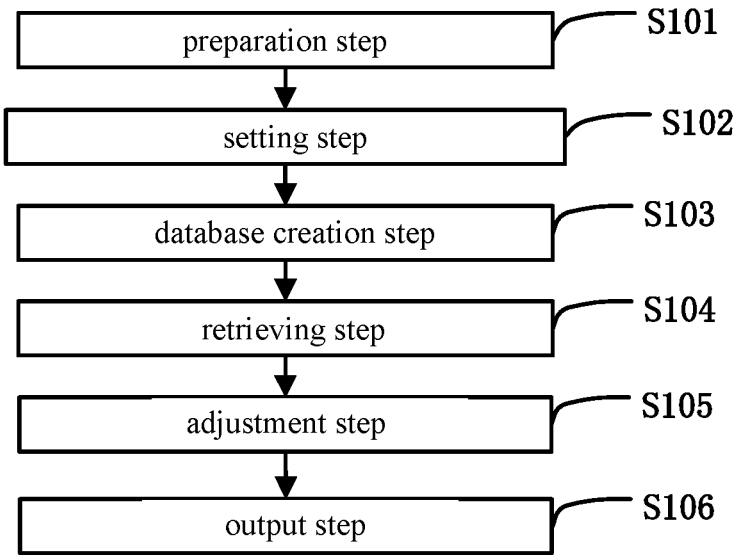
FIG. 1 is a flowchart showing a method of adjusting brightness of a display panel of the present invention.

The following embodiments are referring to the accompanying drawings for exemplifying specific implementable embodiments of the present invention. Directional terms described by the present invention, such as upper, lower, front, back, left, right, inner, outer, side, etc., are only directions by referring to the accompanying drawings. The terms of components mentioned in the present invention, such as the first, second, etc., are only distinguishing between different components, and may have different expressions. In the drawings, structurally similar elements are denoted by the same reference numerals.

As shown in FIG. 1, the present invention provides a method 100 of adjusting brightness of a display panel. The method includes following steps.

A preparation step S101: providing a display panel configured with a central brightness gain factor and peripheral brightness gain factors. A gradation brightness gain factor is further used between the central brightness gain factor and the peripheral brightness gain factors.

A brightness gain factor represents a degree of brightness adjustment, wherein a high gain factor (>1) indicates that the brightness is increasing, and a low gain factor (<1) indicates that the brightness is decreasing.

The gradation brightness gain factor is less than or equal to the central brightness gain factor and is greater than or equal to the peripheral brightness gain factors. The gradation brightness gain factor is applied to areas corresponding to a center of the display panel to a peripheral area of the display panel. The display panel is adjusted according to the gradation brightness gain factor, so that the display panel exhibits a process in which the brightness is gradually changed from the center to peripheral edges.

Figure 2:
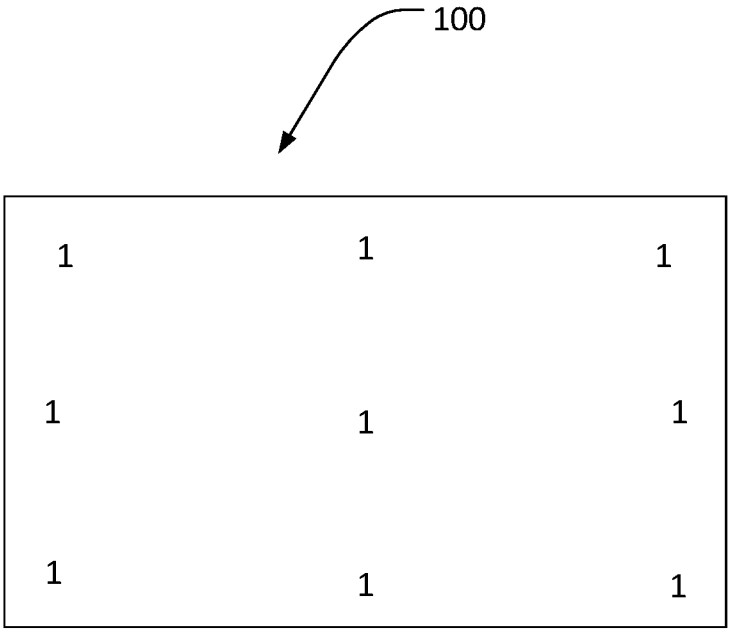
FIG. 2 is a plan view showing brightness gain factors of initialization of a display panel of the present invention.

In the preparation step, in one embodiment, brightness gain factors for any area of the display panel in initialization are equal to each other. As shown in FIG. 2, the central brightness gain factor and the peripheral brightness gain factors are set to one, which is original data of the display panel and the brightness is very uniform.

In another embodiment, peripheral brightness gain factors are less than a central brightness gain factor of the display panel. The display panel in such an embodiment already has brightness gain factors, that is, the display panel is not used for the first time.

Figure 3:
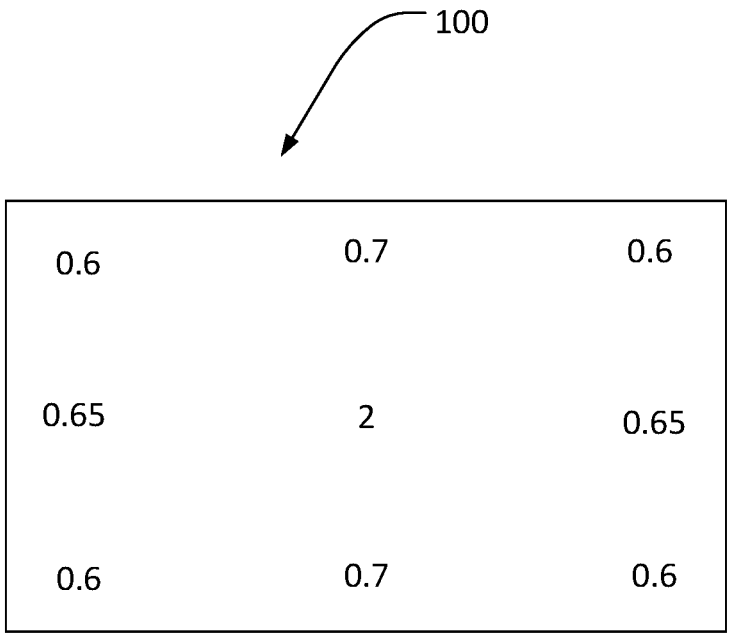
FIG. 3 is a plan view showing brightness gain factors used after a setting step of a display panel of the present application.

A setting step S102: as shown in FIG. 3, obtaining a difference value between first brightness gain factors of a center of a large-sized display panel and first brightness gain factors of peripheral edges of the large-sized display panel by increasing a central brightness gain factor of the display panel, and reducing peripheral brightness gain factors of the display panel.

As a display panel is a small-sized display panel, display effects are seriously influenced when reducing peripheral brightness gain factors of the display panel, so a difference value between the central and peripheral brightness gain factors is set to a small difference value. As a display panel is a large-sized display panel, display effects are less influenced when reducing peripheral brightness gain factors, so a difference value between the central and peripheral brightness gain factors can be set to a small difference value.

A database creation step S103: storing attenuation data and a plurality of first brightness gain factors in a database, wherein the attenuation data is performance attenuation data of a functional device of a display panel, and the first brightness gain factors are provided to display brightness of the display panel. A controller adjusts the brightness of the display panel according to different brightness gain factors.

The attenuation data contains attenuation data of a thin-film transistor device or attenuation data of an organic light-emitting diode (OLED) functional device.

Figure 4:
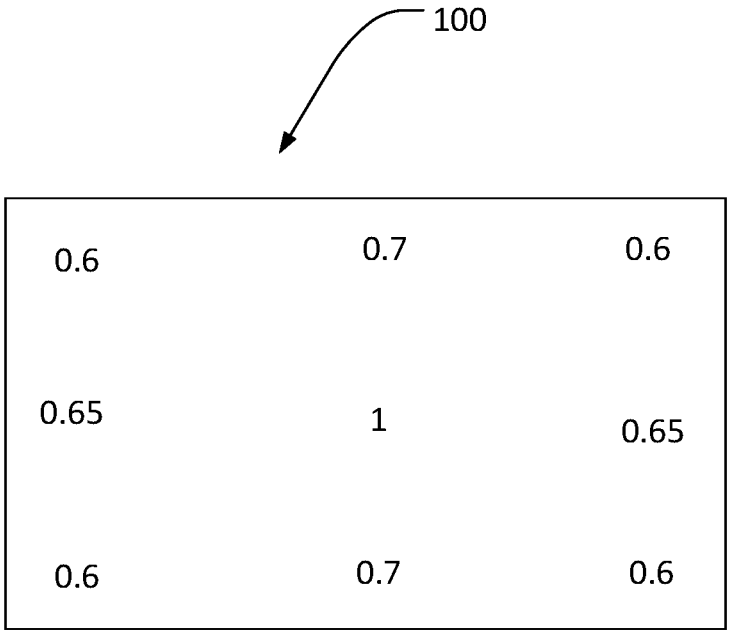
FIG. 4 is a plan view showing brightness gain factors used after an adjustment step of a display panel of the present application.

The attenuation data may be acquired by obtaining attenuation information of a display panel through various methods, such as external compensation detection or data estimation, and is used to generate corresponding brightness adjustment gain factor diagrams (such as FIG. 2, FIG. 3, and FIG. 4). The brightness adjustment gain factor diagrams show brightness gain factors decreasing gradually from the center toward the display panel, thereby implementing a gradual process of brightness of the display panel.

A retrieving step S104: retrieving the attenuation data and the first brightness gain factors from the database.

An adjustment step S105: adjusting the first brightness gain factors according to the attenuation data of the display panel to obtain a plurality of second brightness gain factors.

In the adjustment step, the adjustment step specifically includes decreasing the first brightness gain factors of the center of the display panel to obtain the second brightness gain factor of the center of the display panel when attenuation data of the center of the display panel is increased, thereby to obtain a small difference value between the central brightness gain factor and the peripheral brightness gain factors of the display panel.

When a lifetime of a device at the center position is seriously attenuated, gain factors of the display panel are adjusted to reduce a brightness difference between the center and the peripheral edges of the display panel, thereby improving lifetime degradation of devices at corresponding positions, and reducing adversely influence on a lifetime of a display while brightness adjustment is fulfilled.

The first brightness gain factors of peripheral edges of the display panel are adjusted through a bilinear difference value, according to the adjusted second brightness gain factors of the center of the display panel, to obtain second brightness gain factors of the peripheral edges of the display panel.

The gradation brightness gain factor is adjusted according to the brightness gain factor of the central area and the brightness gain factor of the edge area, thereby realizing the process of the brightness gradually changing from the center to the peripheral edges of the display panel.

An output step S106: outputting the second brightness gain factors to the display panel for screen display.

The present invention provides a method of adjusting brightness of a display panel. Brightness adjustment gain factor diagrams are obtained according to attenuation data of a center and peripheral edges of the display panel (obtaining attenuation information of the display panel by methods, such as external compensation detection or data estimation), thereby to process brightness gain factors of the display panel. When lifetime degradation of a device of the display panel is not serious, a brightness difference between gain factors of a center and peripheral edges of the display panel is set to a large difference value to reduce power consumption. When lifetime degradation of a device at the center position is serious, the gain factors of the display panel are adjusted to reduce a brightness difference between the center and the peripheral edges of the display panel, thereby improving lifetime degradation of devices at corresponding positions, and reducing adversely influence on a lifetime of a display while brightness adjustment is fulfilled.

The present invention further provides a computer-readable storage media, and the storage media is configured to store a computer program, characterized in that the computer program, when executed by a processor, is capable of implementing the method of adjusting brightness of the display panel.

The present invention further provides an electronic device including a memory and a processor. The memory is configured to store executable program code. The processor runs a program corresponding to the executable program code by reading the executable program code to perform steps in method of adjusting brightness of the display panel as described above.

The technical scope of the present invention is not limited only to the contents of the description. A person skilled in the art can make various modifications and changes to the embodiments without departing from the spirit and scope of the invention, and such modifications and modifications are within the scope of the invention.

What is claimed is:

1. A method of adjusting brightness of a display panel, comprising:

a preparation step: providing the display panel configured with a central brightness gain factor and peripheral brightness gain factors;

a setting step: obtaining a larger difference value between first brightness gain factors of a center of the display panel and first brightness gain factors of peripheral edges of the display panel by increasing the central brightness gain factor and reducing the peripheral brightness gain factors:

a database creation step: storing attenuation data and the first brightness gain factors in a database, wherein the attenuation data is performance attenuation data of a functional device of a display panel, and the first brightness gain factors are provided to display brightness of the display panel;

a retrieving step: retrieving the attenuation data and the first brightness gain factors from the database; and an adjustment step: adjusting the first brightness gain factors according to the attenuation data to obtain a plurality of second brightness gain factors.

2. The method of adjusting brightness of the display panel of claim 1, further comprising an output step: outputting the second brightness gain factors to the display panel for screen display.

3. The method of adjusting brightness of the display panel of claim 1, wherein the attenuation data contains attenuation data of a thin-film transistor device or attenuation data of an organic light-emitting diode (OLED) functional device.

4. The method of adjusting brightness of the display panel of claim 1, wherein in the preparation step, both the central brightness gain factor and the peripheral brightness gain factors of initialization are the same as each other.

5. The method of adjusting brightness of the display panel of claim 1, wherein a gradation brightness gain factor is further provided between the central brightness gain factor and the peripheral brightness gain factors, and the gradation brightness gain factor is less than or equal to the central brightness gain factor and is greater than or equal to the peripheral brightness gain factors.

6. A non-transitory computer-readable storage media, storing a computer program, wherein the computer program, when executed by a processor, is capable of implementing the method of claim 1.

7. A method of adjusting brightness of a display panel, comprising:

a preparation step: providing the display panel configured with a central brightness gain factor and peripheral brightness gain factors;

a database creation step: storing attenuation data and a plurality of first brightness gain factors in a database, wherein the attenuation data is performance attenuation data of a functional device of a display panel, and the first brightness gain factors are provided to display brightness of the display panel;

a retrieving step: retrieving the attenuation data and the first brightness gain factors from the database; and an adjustment step: adjusting the first brightness gain factors according to the attenuation data to obtain a plurality of second brightness gain factors, and decreasing the first brightness gain factors of a center of the display panel to obtain the second brightness gain factor of the center of the display panel when attenuation data of the center of the display panel is increased, thereby to obtain a small difference value between the central brightness gain factor and the peripheral brightness gain factors of the display panel.

8. The method of adjusting brightness of the display panel of claim 7, further comprising an output step: outputting the second brightness gain factors to the display panel for screen display.

9. The method of adjusting brightness of the display panel of claim 7, wherein the attenuation data contains attenuation data of a thin-film transistor device or attenuation data of an organic light-emitting diode (OLED) functional device.

* * * * *